US005702182A

United States Patent [19]

Alvarado

[11] Patent Number: 5,702,182

[45] Date of Patent: Dec. 30, 1997

[54] APPARATUS FOR MIXING SELECTED VOLUMES OF LIQUIDS

[75] Inventor: Ulises R. Alvarado, King of Prussia, Pa.

[73] Assignee: Instrumentation Technology Associates, Inc., Exton, Pa.

[21] Appl. No.: 685,567

[22] Filed: Jul. 24, 1996

[51] Int. Cl.[6] ..... B01F 5/12

[52] U.S. Cl. ..... 366/130; 366/267; 206/219

[58] Field of Search ..... 206/219, 222; 366/130, 189, 256, 267–269, 275, 332–336, 340

[56] References Cited

U.S. PATENT DOCUMENTS

| | | | |
|---|---|---|---|
| 3,496,970 | 2/1970 | Pontigny . | |
| 3,700,215 | 10/1972 | Hardman et al. | 366/332 X |
| 3,743,141 | 7/1973 | Mnilk et al. . | |
| 3,870,147 | 3/1975 | Orth | 206/222 |
| 4,208,483 | 6/1980 | Lee . | |
| 4,350,650 | 9/1982 | Cereghini | 366/267 X |
| 4,366,839 | 1/1983 | Slavin . | |
| 4,463,875 | 8/1984 | Tepic | 206/219 X |
| 4,469,153 | 9/1984 | Morrisette | 366/333 X |
| 4,783,413 | 11/1988 | Suter . | |
| 4,909,933 | 3/1990 | Carter et al. . | |
| 5,188,455 | 2/1993 | Hammerstedt . | |

FOREIGN PATENT DOCUMENTS

| | | | |
|---|---|---|---|
| 2800587 | 7/1979 | Germany | 206/219 |

*Primary Examiner*—Charles E. Cooley
*Attorney, Agent, or Firm*—Howson and Howson

[57] ABSTRACT

The apparatus for mixing two or more liquids in the microgravity environment of space consists of a rigid tube containing seals and valves defining a series of separate chambers to accommodate experimental liquid specimens. Upon controlled actuation in a syringe-like fashion, the valves open passages between the chambers, allowing the liquids to flow and mix, following a predetermined sequence. Compactness of the apparatus permits many such devices to be accommodated in a relatively small volume in the carrying spacecraft.

9 Claims, 1 Drawing Sheet

APPARATUS FOR MIXING SELECTED VOLUMES OF LIQUIDS

BACKGROUND OF THE INVENTION

1. Field of the Invention

The invention relates in general to an apparatus for mixing accurately proportioned volumes of liquids, and in particular to an apparatus for mixing liquids during experiments conducted in the microgravity environment of space.

2. Description of Prior Art

At present, many experiments involving the mixing of fluids are conducted in the microgravity environment of orbital space flight to take advantage of the effects of the greatly reduced gravity, especially the reduced convection, reduced container contact, and reduced sedimentation. Experimentation in disciplines such as cell biology, plant biology, macro-molecular chemistry, inorganic crystallography and micro-encapsulation of medicinal drugs often requires thorough mixing of two or more liquids combined in precise proportions at controlled rates of mixing. A typical example of a liquids mixing experiment conducted in microgravity is the mixing in space of a protein substance such as lysozyme with a salt solution to produce crystals of structural quality higher than the structural quality of crystals similarly produced in the convective environment on earth. The large number of possible combinations of experimental parameters such as the volumetric ratios of the combining liquids requires that many experimental samples be collected during each space flight, in order to produce statistically significant experimental results. This need for a multiplicity of data points, coupled with the need for effective utilization of the valuable volumetric capacity, and the limited number of space flights, dictates that the apparatus used in liquid mixing experiments be compact and inexpensive. Furthermore, it requires a simple construction with few parts, to make the device less susceptible to malfunction in the high vibration and acceleration environment of space vehicle launch and reentry.

Non gravity-dependent systems devised for use in terrestrial laboratories have been utilized extensively for mixing liquids The prior art includes many such devices that are relatively large and require many parts. For example, Mnilk U.S. Pat. No. 3,743,141 describes a mixing apparatus that requires multiple vessels, pistons, valves and a pump. The apparatus described in Pontigny U.S. Pat. No. 3,496,970 requires separate liquid containers and a reciprocating pump. Slavin U.S. Pat. No. 4,366,839 describes an apparatus utilizing multiple storage tanks, a specialized selector valve assembly and a pump. The apparatus in Lee U.S. Pat. No. 4,208,483 has multiple vessels holding fluids, a pump and cylindrical bottle with a fluid-dispensing rotating shaft.

Also included in the prior art is a second category of systems, specifically designed for microgravity applications that employ diffusion of one fluid into another, rather than rapid dispersion, as the mixing mechanism. For instance, Carter et al. U.S. Pat. No. 4,909,933 describes an apparatus with multiple chambers within a housing, and a rotating valve that communicates two or (in an alternate embodiment) three of those chambers. Other systems in this category include a variety of apparatus employing osmotic pumps, which operate independently of gravity. A typical example of those systems, described in Suter U.S. Pat. No. 4,783,413, uses an osmotic pump to supply a continuous flow of a fluid contained in one chamber to a reaction chamber. This category of systems is suitable for applications requiring diffusive or osmotic mixing and are not used in applications requiring rapid dispersion or turbulent-flow mixing of liquids.

A third category of apparatus is specifically designed to operate in a microgravity environment, is suitable for rapid dispersion or turbulent mixing. The prior art in this category is exemplified by the apparatus in Hammerstedt U.S. Pat. No. 5,188,455, which includes a flexible tubular member wherein a series of yokes and plates that apply pressure on the tubular member controls the communication and flow of fluids between segments (or segmented chambers) in the tubular member. Another example is the Bio-processing Module (BPM) employed by the Consortium for Materials Development in Space which uses one syringe for each liquid to be mixed and a stopcock valve and interconnecting tubing to control the communication of fluid between the syringes.

The invention described herein improves the compactness and simplicity of construction of fluid mixing systems as compared to the prior art exemplified in the systems cited above. The use of a small number of easily constructed parts contributes to the structural integrity, economy and reliability of the device.

SUMMARY OF THE INVENTION

The principal object of this invention is to provide a compact, simply constructed apparatus for mixing a plurality of liquid samples in the microgravity environment of space. Another important object of this invention is to provide a versatile mixing apparatus that can be easily adapted to different liquid sample volumes. Still another object of the invention is to provide a mixing apparatus that can be constructed from readily available or easily fabricated parts. Still another object is to provide a mixing apparatus that is highly reliable.

The mixing apparatus in accordance with the invention comprises a rigid tube having a cylindrical inner wall, a front piston and a rear piston located within the tube in spaced relation to each other and in sealing relationship with the inner wall of the tube, and dividing means fixed within the tube at a location spaced from the front and rear pistons, for dividing the interior of the tube into at least two separate chambers. The dividing means includes initially closed valve means, responsive to a pressure differential across the dividing means, for allowing liquid to flow, past the dividing means, from one of the chambers into another when the rear piston is moved toward the dividing means. An actuator is provided for causing the rear piston to move toward the dividing means.

Preferably, the dividing means comprises a frame, and the valve means is an O-ring supported on the frame and in contact with the cylindrical inner wall of the rigid tube. A preferred frame comprises an element having a perimeter comprising a plurality of arcuate sections in contact with the inner wall of the rigid tube, and portions between the arcuate sections spaced from the inner wall of the rigid tube to provide flow passages.

The O-ring is preferably supported on a circular element extending from the first element in a direction toward the front piston.

In the case of a device for mixing three or more liquids, additional dividing means are located within the tube in spaced relations to the fixed dividing means and the rear piston, for dividing the space within the tube between the fixed dividing means and the rear piston into at least two separate chambers. The additional dividing means includes additional valve means, responsive to a pressure differential across the additional dividing means, for allowing liquid to flow, past the additional dividing means, from one of the two separate chambers to the other. A preferred form of additional dividing means comprises a frame slidable within the tube, and the additional valve means is preferably an O-ring supported on the additional frame and in contact with the cylindrical inner wall of the rigid tube. The additional dividing means comprises a first element having a perimeter with at least portions thereof adjacent to the inner wall of the rigid tube, and an element having a circular cross section and extending from the first element in a direction toward the fixed dividing means. The circular element extends into and supports the O-ring. A spacer limits movement of the movable dividing means toward the fixed dividing means to allow room for movement of the O-ring on the additional frame in response to a differential pressure across the additional dividing means, so that liquid can flow past the additional dividing means when the rear piston causes a differential pressure across the additional dividing means.

The liquids are mixed by actuating the apparatus, that is, moving an actuator through the distance necessary to effect the required displacement and mixing of the liquids. The valves can be located in a wide variety of relative positions along the tube, to allow mixing of the liquids in the specific volumetric proportion required by the mixing process. In the typical embodiment of the invention, two liquids are mixed during a single actuation. The apparatus is constructed so that an astronaut actuates each unit individually. However, a plurality of units can be ganged together and actuated simultaneously by an external motor.

Further objects, details and advantages of the invention will be apparent from the following detailed description, when read in conjunction with the drawings.

DETAILED DESCRIPTION

Figure 1:
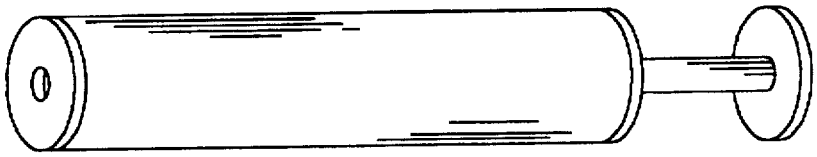
FIG. 1 is an isometric view of the exterior of a typical mixing apparatus in accordance with the invention.

FIG. 1 shows the external configuration of a typical mixing unit. A typical installation for experimentation onboard a spacecraft will include a plurality of these liquids mixing units, arranged for sequential actuation by the astronaut or ganged together so that they can be actuated by a motor.

Figure 2:
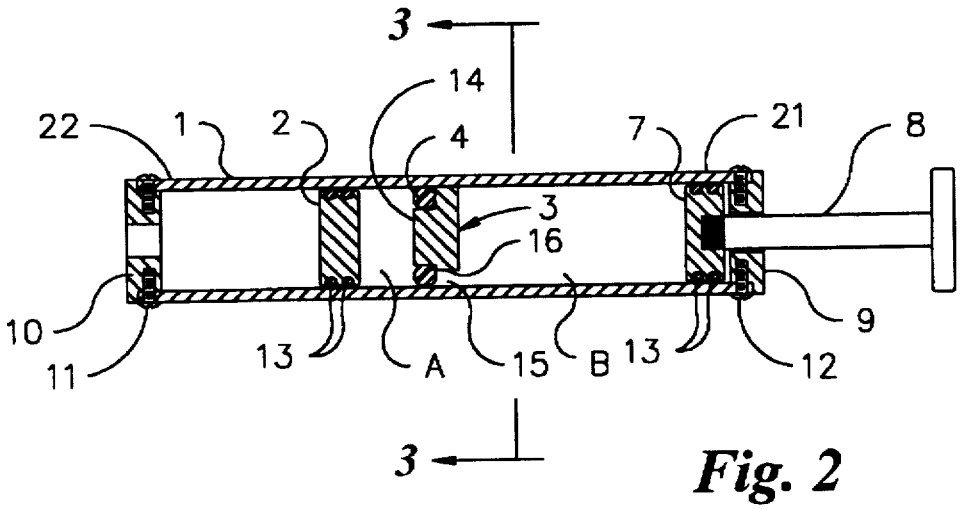
FIG. 2 is an axial section of the mixing apparatus in a configuration used for mixing two liquids.

The mixing unit shown in FIG. 2, is for mixing measured volumes of two liquids initially contained in chambers A and B. The device comprises a rigid tube 1, preferably made of a transparent material such as polycarbonate or glass. A front piston 2 defines an end of chamber A, and a rear piston 7 defines an end of chamber B. Thus, the two pistons serve to contain the two liquids within tube 1. Pistons 2 and 7 contain flexible sealing elements such as those used in commercially available syringes. In the preferred embodiment, each of the pistons 2 and 7 is provided with silicone rubber O-ring seals 13, situated within circumferential grooves.

Before initiation of the mixing process, liquids within chambers A and B are separated from each other by a fixed valve consisting of a fixed valve frame 3 and an O-ring 4. The fixed valve frame 3 has a cylindrical extension 14 for mounting the O-ring seal 4, and the O-ring is compressed radially between extension 14 and the inner surface of the rigid tube 1. The compression of the O-ring seal 4 is sufficient to maintain isolation between the liquids in chambers A and B prior to movement of the actuator 8 during the mixing process. In the typical embodiment, the valve frame is made of a metal such as stainless steel, and the O-ring 4 is made of a flexible material such as silicone rubber. The actuator 8 is rigidly attached to the rear piston 7 so that the rear piston can be moved by pushing the actuator forward along the longitudinal axis of tube 1.

Located at the rear end 21 of the rigid tube 1 is an actuator guide bushing 9, which has a central hole, receiving the shaft of actuator 8 and maintaining alignment of the shaft of the actuator with the axis of tube 1. The actuator guide bushing is secured to tube 1 by screws 12. A front retainer 10, which is secured to the front end 22 of the tube by screws 11, serves as a safety stop to prevent the front piston 2 from being removed from the rigid tube 1.

Figure 3:
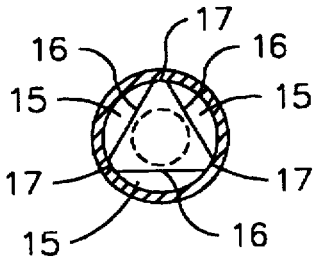
FIG. 3 is transverse cross-sectional view, taken on plane 3—3 of FIG. 2, showing the details of a fixed valve in the mixing apparatus.

The fixed valve frame 3 is secured to the inner surface of the rigid tube 1 at a location along the longitudinal axis of the rigid tube that is pre-determined to provide room for the desired volumes of liquids in chambers A and B prior to and after the mixing process. In the preferred embodiment, the fixed valve frame 3 is bonded to the rigid tube 1 by epoxy or other suitable adhesive. Alternatively, it can be secured in place by fasteners. As illustrated in the FIG. 3, three liquid passages 15 are provided between the inner surface of the rigid tube 1 and three, symmetrically spaced, non-adjoining flat surfaces 16 of the valve frame 3. The cylindrical parts 17 of the valve frame conform to, and are bonded adhesively to, the cylindrical inner surface of tube 1.

In the operation of the device of FIG. 2, as a preliminary step, liquids are loaded into the chambers A and B. The fixed valve O-ring seal 4 is installed on the cylindrical extension 14 of the fixed valve frame 3. A measured volume of the first liquid is poured, through the front end of tube 1, into chamber A in front of the O-ring 4. Front piston 2 is inserted through the front end of the rigid tube while the entrapped air between the piston and the surface of the liquid is vented out. The venting of air can be achieved by placing a thin wire between the wall of the tube and the O-ring seals 13 of front piston 2. Alternatively, the wire can be placed between the fixed valve O-ring seal 4 and the inner surface of the rigid tube. The vent wire is removed after the forward face of the front piston 2 has reached the level of the liquid.

With rigid tube 1 in a vertical position, a measured volume of the second liquid is poured into chamber B at the rear of the fixed valve frame 3. The rear piston 7 is inserted in the rigid tube and lowered to the level of the third liquid while venting the entrapped air by means of a venting wire located between the inner wall of the tube and the O-rings 13 of piston 7.

The two-liquid mixing apparatus in the typical embodiment requires a single actuation step, i.e., a measured movement of the actuator 8 in the forward direction, forcing the rear piston 7 to move into rigid tube 1 so that the volume of chamber B decreases. This causes the hydraulic pressure in chamber B to increase, and the result is that the differential in the hydraulic pressure across the fixed valve O-ring seal 4 rises, producing a force on the rear face of the O-ring seal 4 exceeding the frictional force holding it between the rigid tube 1 and the fixed valve frame extension 14. This force causes a segment of the O-ring seal 4 to become displaced beyond the plane of the front face of extension 14, thus opening a path between chambers A and B. As continued force is applied to the rear piston 7, the hydraulic pressure in the connected chambers A and B overcomes the frictional force holding the front piston 2 in place. The front piston, therefore, moves forward to make room for the liquid flowing from chamber B into chamber A. The flow of the liquids continues until the measured quantity of the liquid in chamber B has mixed with the liquid in chamber A.

Figure 4:
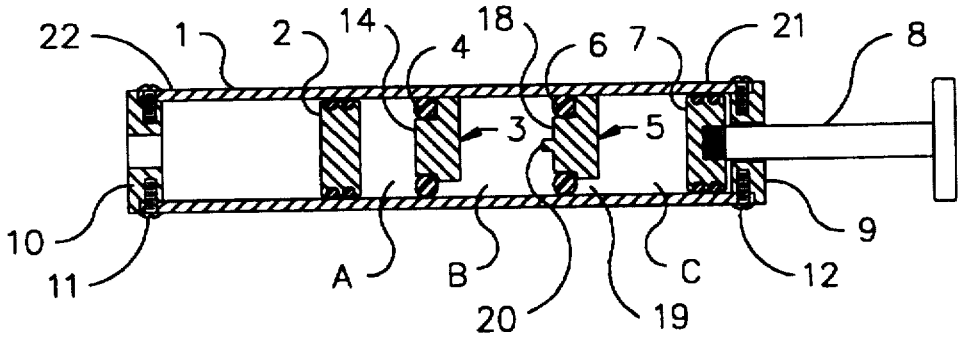
FIG. 4 is an axial section of the mixing apparatus in a configuration used for mixing three liquids.

The alternate embodiment of the invention, shown in FIG. 4, is used in applications requiring the mixing of three liquids. The device is substantially identical to the device of FIG. 4, except that it also includes a movable valve comprising a frame 5 having an O-ring seal 6 on a cylindrical extension 18, which serves to separate a chamber C from chamber B. The movable valve frame 5 is not secured to the rigid tube 1 and thus is free to move axially within the tube. The movable valve frame 5 and O-ring seal 6 typically are made of stainless steel and a silicone rubber, respectively. The cross-section of frame 5 is similar to that of frame 3, in that flat surfaces provide passages, e.g. passage 19, for the flow of liquid between the outer surface of the frame 5 and the inner surface of rigid tube 1. The procedure for filling the liquids in chamber A is the same as that described for the embodiment of FIG. 2. After loading the liquids for chambers A and B in the rigid tube 1 region aft of the fixed valve, the movable valve frame 5, with its mounted O-ring seal 6, is installed in tube 1. Then the liquid for chamber C is loaded in the region aft of the movable valve, and the rear piston is installed. Venting of entrapped air during the process of charging liquids in the device of FIG. 4 is achieved by the use of venting wires in the manner described with reference to FIG. 2.

As the actuator 8 is pushed forward, the O-ring seal 4 on the fixed valve frame 3 is displaced, and the liquid in chamber B flows into chamber A. A small protrusion 20 on the movable valve frame 5 engages the rear face of fixed valve frame 3 to provide a space between the fixed and movable valve frames when the movable valve frame comes to a stop. This space is necessary to allow the O-ring seal 6 to be displaced in order to allow liquid from chamber C to flow into chamber A as the actuator is pushed still farther forward. Alternatively, the protrusion can be provided on frame 3, extending toward the rear piston. When the actuator is pushed so that the rear piston moves deeper into the rigid tube 1, the resulting hydraulic pressure differential across the movable O-ring seal 6 rises, producing a force exceeding the frictional force holding the O-ring seal between the movable valve frame 5 and the rigid tube 1. A segment of the O-ring seal 6 is displaced beyond the extension 18 of the movable valve frame 5, thus opening communication between the chamber C, and the previously mixed two liquids in chamber A. The second actuation is terminated when the rear piston 7 has reached the limit of its travel and the liquid in chamber C has mixed with the resulting mixture from the first actuation. In space flight applications, the step in which the liquid in chamber C is mixed with the liquid mixture in chamber A may be programmed to take place prior to space vehicle re-entry and return of the experimental samples. This is accomplished by pushing the actuator through a first defined distance in the first mixing step, and only continuing the forward movement of the actuator when the second mixing step is to be carried out.

The invention achieves the objects of compactness and simplicity of construction through a reduction in the complexity inherent in prior art. The reduction in complexity is achieved in particular by accommodating the liquids to be mixed and the required sealing pistons and valves within a simple tubular element, without the need of external piping and valves. The tubing for constructing the rigid tubular elements 1, as well as the sealing elements used in the pistons 2 and 7 and valve O-ring seals 4 and 6, are available commercially in a variety of materials and sizes and do not require special molding or machining. The principal components of the invention are a rigid tube, typically made of transparent plastic or glass, wherein two pistons serve to contain the liquids, valves separating the liquids before mixing, and an actuator allowing activation of the mixing process.

The foregoing description of the typical embodiment of the invention has been presented for the purposes of illustration and description, and it is not intended to be exhaustive or to limit the invention to the precise form disclosed. Thus, various modifications can be made to the apparatus described. For example, another embodiment of the invention may be used in applications requiring the mixing of more than three liquids. This is achieved by one or more additional movable valves each corresponding the frame 5 and seal 6 of FIG. 4. One additional movable valve is required for each additional liquid exceeding three. The procedure for loading of the liquids and actuation in the modifications in which four or more liquids are to be mixed, are essentially as described for the embodiment of FIG. 4, except that provisions are made for the additional liquids, movable valves, and for additional actuation steps during the mixing process.

In still another modification of the invention, useful in applications requiring diffusive mixing of a primary liquid such as a protein solution, with a liquid or mixture of liquids contained in chamber A, non-turbulent mixing is attained by allowing the flow of one liquid into the other by diffusion of the liquid across a porous membrane. In this modification, one or more auxiliary vials are located within chamber A, for the purpose of containing one or a plurality of additional liquids. Each of the vials is separated from the liquid in chamber A by a porous membrane such as a filtering material, osmotic membrane or dialysis membrane.

Many other modifications and variations are possible in light of the above presentation. It is intended that the scope of the invention be limited not by this detailed description, but rather by the claims appended hereto.

I claim:

1. An apparatus for mixing selected volumes of liquids comprising:

a rigid tube having a cylindrical inner wall;

front piston means and rear piston means located within the tube in spaced relation to each other and in sealing relationship with the inner wall of the tube, each of said front and rear piston means preventing fluid communication from the space within the tube on each side thereof to the space within the tube on the other side thereof;

dividing means fixed within the tube at a location spaced from the front and rear pistons, for dividing the space within the interior of the tube between the front and rear pistons into at least two separate chambers, the dividing means including initially closed valve means, opening in response to a pressure differential across said dividing means, for allowing liquid to flow, past the dividing means, from one of said chambers into another when the rear piston is moved toward the dividing means; and actuating means for causing the rear piston to move toward the dividing means.

2. An apparatus for mixing selected volumes of liquids comprising:

a rigid tube having a cylindrical inner wall;

a front piston and a rear piston located within the tube in spaced relation to each other and in sealing relationship with the inner wall of the tube;

dividing means fixed within the tube at a location spaced from the front and rear pistons, for dividing the interior of the tube into at least two separate chambers, the dividing means including initially closed valve means, opening in response to a pressure differential across said dividing means, for allowing liquid to flow, past the dividing means, from one of said chambers into another when the rear piston is moved toward the dividing means; and actuating means for causing the rear piston to move toward the dividing means;

in which the dividing means comprises a frame, and the valve means is an O-ring supported on the frame and in contact with the cylindrical inner wall of the rigid tube.

3. An apparatus according to claim 2 in which the frame comprises an element having a perimeter comprising a plurality of arcuate sections in contact with the inner wall of the rigid tube, and portions between the arcuate sections spaced from the inner wall of the rigid tube to provide flow passages.

4. An apparatus according to claim 2 in which the frame comprises a first element having a perimeter with at least portions thereof in contact with the inner wall of the rigid tube, and a circular element extending from the first element in a direction toward the front piston, the circular element extending into and supporting the O-ring.

5. An apparatus according to claim 2 in which the frame comprises a first element having a perimeter comprising of a plurality of arcuate sections in contact with the inner wall of the rigid tube, and portions between the arcuate sections spaced from the inner wall of the rigid tube to provide flow passages, and in which the frame also comprises a circular element extending from the first element in a direction toward the front piston, the circular element extending into and supporting the O-ring.

6. An apparatus for mixing selected volumes of liquids comprising:

a rigid tube having a cylindrical inner wall;

a front piston and a rear piston located within the tube in spaced relation to each other and in sealing relationship with the inner wall of the tube;

dividing means fixed within the tube at a location spaced from the front and rear pistons, for dividing the interior of the tube into at least two separate chambers, the dividing means including initially closed valve means, opening in response to a pressure differential across said dividing means, for allowing liquid to flow, past the dividing means, from one of said chambers into another when the rear piston is moved toward the dividing means;

actuating means for causing the rear piston to move toward the dividing means; and additional dividing means located within the tube in spaced relations to the fixed dividing means and the rear piston, for dividing the space within the tube between the fixed dividing means and the rear piston into two separate chambers, and in which the additional dividing means includes additional initially closed valve means, opening in response to a pressure differential across the additional dividing means, for allowing liquid to flow, past the additional dividing means, from one of said two separate chambers to the other.

7. An apparatus according to claim 6 in which the additional dividing means comprises an additional frame slidable within said tube, and the additional valve means is an O-ring supported on the additional frame and in contact with the cylindrical inner wall of the rigid tube.

8. An apparatus according to claim 7 in which the additional dividing means comprises a first element having a perimeter with at least portions thereof adjacent to the inner wall of the rigid tube, and a circular element extending from the first element in a direction toward the fixed dividing means, the circular element extending into and supporting the O-ring.

9. An apparatus according to claim 7 in which one of said dividing means includes spacer means for limiting movement of the movable dividing means toward the fixed dividing means and thereby allowing room for movement of the O-ring on the additional frame in response to a differential pressure across the additional dividing means, whereby liquid can flow past the additional dividing means when the rear piston causes a differential pressure across the additional dividing means.

* * * * *